US009782689B1

(12) United States Patent
Stiber

(10) Patent No.: US 9,782,689 B1
(45) Date of Patent: Oct. 10, 2017

(54) INTEGRATED HAND-HELD CATCH NET APPARATUS

(71) Applicant: Michael Stiber, Honolulu, HI (US)

(72) Inventor: Michael Stiber, Honolulu, HI (US)

( * ) Notice: Subject to any disclaimer, the term of this patent is extended or adjusted under 35 U.S.C. 154(b) by 0 days.

(21) Appl. No.: 15/418,795

(22) Filed: Jan. 30, 2017

(51) Int. Cl.

| | |
|---|---|
| ***A63H 33/00*** | (2006.01) |
| ***A63H 33/26*** | (2006.01) |
| ***A63H 3/00*** | (2006.01) |
| ***A63H 3/28*** | (2006.01) |
| ***A63J 21/00*** | (2006.01) |
| ***A63H 3/36*** | (2006.01) |
| *A63F 9/24* | (2006.01) |

(52) U.S. Cl.
CPC ..... *A63H 33/26* (2013.01); *A63H 3/006* (2013.01); *A63H 3/28* (2013.01); *A63H 3/36* (2013.01); *A63H 33/00* (2013.01); *A63J 21/00* (2013.01)

(58) Field of Classification Search
CPC . A63H 3/00; A63H 3/006; A63H 3/28; A63H 33/00; A63H 33/04; A63H 33/22; A63F 13/211; A63F 9/24; A63F 2333/00; A63F 2300/6063
USPC .... 446/175, 219, 227, 242, 266, 484; 463/1, 463/10
See application file for complete search history.

(56) References Cited

U.S. PATENT DOCUMENTS

| | | | | |
|---|---|---|---|---|
| 6,431,937 | B1 * | 8/2002 | Lau | A63H 3/28 446/175 |
| 6,626,728 | B2 * | 9/2003 | Holt | A63H 33/00 446/175 |
| 7,878,905 | B2 * | 2/2011 | Weston | A63F 13/211 463/10 |
| 8,876,604 | B2 * | 11/2014 | Casino | A63F 9/24 463/1 |

* cited by examiner

*Primary Examiner* — Kien Nguyen
(74) *Attorney, Agent, or Firm* — The Rapacke Law Group, P.A.

(57) ABSTRACT

Embodiments described provide an integrated hand-held catch net apparatus including a multi-axis sensor in electrical communication with a microcontroller and memory module to provide a plurality of colored light schemes and pre-programmed sounds/songs in responds to movement and tilting of the apparatus. Further included is a light toy figurine releasably attached to the catch net assembly to simulate capture both a fish or insect.

14 Claims, 4 Drawing Sheets

INTEGRATED HAND-HELD CATCH NET APPARATUS

FIELD

The embodiments presented relate to an integrated hand-held catch net apparatus, and in particular, to an integrated hand-held catch net which enables the operator to activate a variety of colored lighting schemes and pre-programmed sounds within a portable hand-held wand having a releasably attached toy figurine.

BACKGROUND

Play wands and play structures have been used for centuries to entertain children and adults alike. In the last few years, a variety of interactive toys combines learning with entertainment in a portable toy/game to facilitate reading, memory stimulation, and tactile coordination.

Magic Toy wands and wizardry are classic play themes which continue to capture and stimulate multiple generations of users. Magic and sorcery continue to be the driving play theme from popular children movies, theme park character, and amusement rides which attempt to capture the imagination and provide endless possibilities of fun in a hyper-interactive and social atmosphere.

While there have been many games, toys, and play patterns which incorporate magic and wizardry, these devices merely provide a superficial interactive experience, particularly for older children. Few of these devices on the market today connect children, magic, and nature with a portable and highly tactile device.

Though there are several methods and systems which provide an interactive play experience within a portable toy such as U.S. Pat. No. 7,445,550 to Barney et al.; U.S. Pat. No. 6,265,984 to Molinaroli; and U.S. Pat. No. 6,150,947 to Shima. Despite these numerous patents and published applications, there is not a single reference which provides for a highly interactive and tactile hand-held device which allows for a plurality of colored light schemes and pre-programmed sounds which simulate interacting with nature by depressing a push-button actuator.

SUMMARY OF THE INVENTION

Embodiments described herein provide an integrated hand-held catch net apparatus which includes a plurality of colored light emitting diodes contained within a hermetically sealed translucent body and catch net assembly which is further controlled using a microcontroller with a pre-preprogrammed memory module. The apparatus is configured to be selectively lit or alternatively play a plurality of pre-programmed songs through a Bluetooth speaker which may be further connected over a wireless network. Further, the apparatus includes a multi-axis sensor which is connected to both the microcontroller and plurality a plurality of colored light emitting diodes (LED) which enable a plurality of light schemes and pre-programmed sounds to be actuated when the elongated body of the apparatus is moved between positions.

The embodiments further provide a toy figurine releasably attached to the catch net using a spring-like device which simulates catching an insect in mid-air when twirled by the user. The catch net assembly is releasably attached to the first end of the elongated and translucent body at a coupling and contains a strand of light emitting diodes contained within the hermetically sealed and translucent body about the perimeter. The microcontroller, memory module and speaker are electrically connected to the battery (i.e., power) supply, push-button actuator, and on/off switch located within the handle portion of the apparatus opposite the catch net assembly. The microcontroller further includes a timer which is pre-programmed to control the duration of the light scheme and sound.

The embodiments enable the operator to depress a push-button on the outside surface of the handle portion a pre-selected number of times to energize the strand of light emitting diodes, Bluetooth speaker, and pre-programmed sounds within the memory module. Further, the apparatus is designed to be twirled into the air to capture insects or simulate catching the toy figurine within the fabric catch net.

Other aspects, advantages, and novel features of the embodiments will become apparent from the following detailed description in conjunction with the drawings.

BRIEF DESCRIPTION OF THE DRAWINGS

A more complete understanding of the embodiments, and the attendant advantages and features thereof, will be more readily understood by reference to the following detailed description when considered in conjunction with the accompanying drawings wherein.

DETAILED DESCRIPTION

The specific details of the single embodiment or variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

The embodiments provide an integrated hand-held catch net apparatus having a toy figurine releasably attached to the disc-shaped catch net which is designed to be twirled in the air by the user to catch insects or simulate capturing the toy figurine within the fabric catch net. The interactive apparatus further includes a plurality of colored light emitting diodes contained within a hermetically sealed elongated body which connects the catch net assembly at the first end and handle portion at the opposite second end. The user may control the color schemes and sound selection by depressing the push-button actuator a number of times until the desired setting is achieved. One example of operation would be to energize the apparatus by placing the switch in the "on" position, depressing the push-button actuator at least once and having both a colored light scheme and pre-programmed sound play for a pre-determined period of time.

Figure 1:
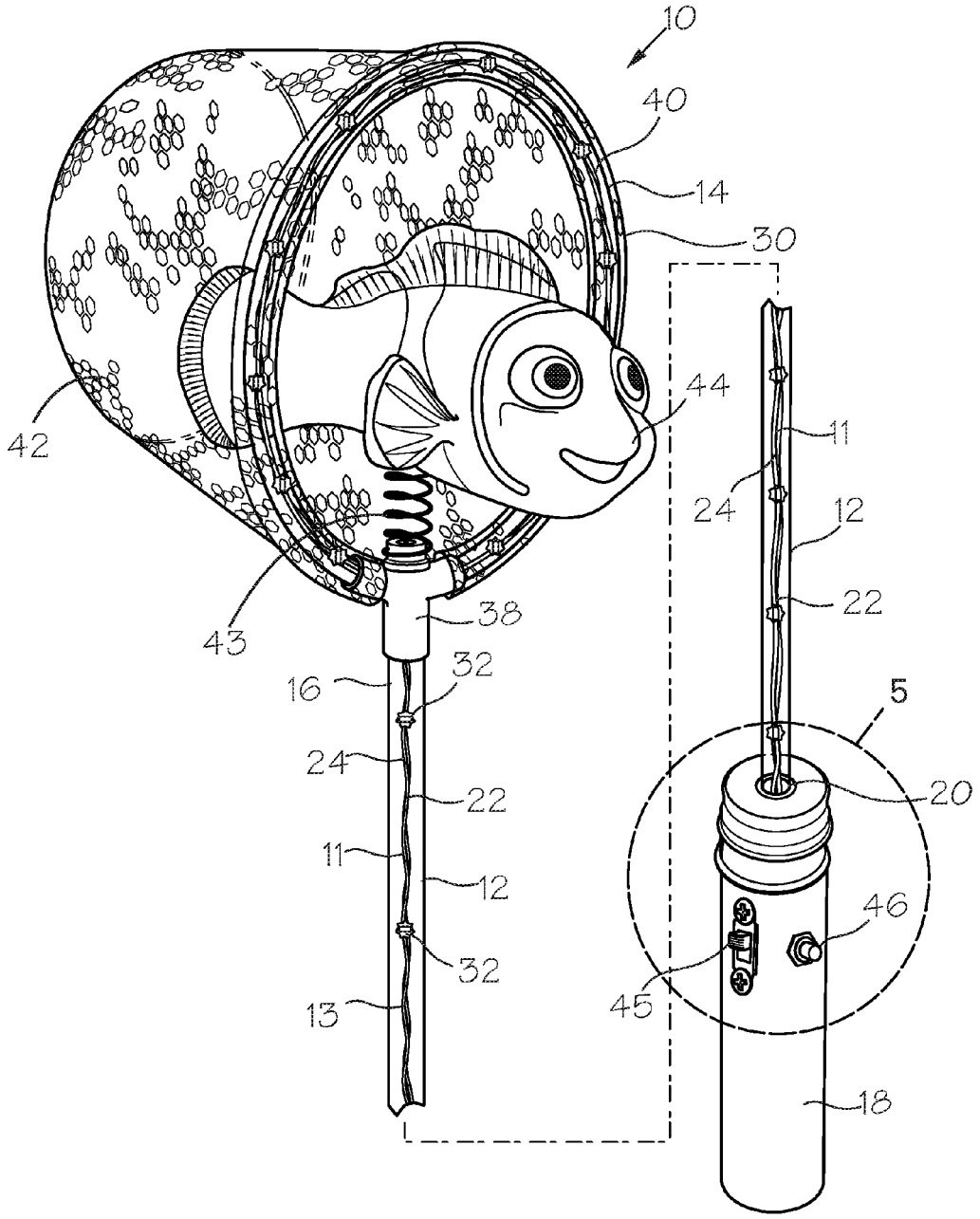
FIG. 1 is a perspective view of an integrated hand-held catch net apparatus.

Referring now to the drawings wherein like reference numerals designate identical or corresponding parts throughout the views. There is shown in FIG. 1 an integrated hand-held catch net apparatus which enables an operator to illuminate an enclosed illuminable strand of Light Emitting Diodes (LED) 11. The apparatus 10 is comprised of an elongated and translucent body 12 having a disc-shaped catch net assembly 14 releasably attached at the first end of the elongated body 16 and a handle portion 18 affixed to the second end of the elongated body 20. It is contemplated the apparatus 10 is comprised of a high durometer material such as a plastic or thermoplastic material. However, any high durometer material may be used as long it is translucent and provides a hermetic seal.

The elongated body 12 is linearly designed in a wand-like configuration having a length 13 extending from the first end of the elongated body 16 to the second end of the elongated body 20. The linearly shaped elongated body is further designed to provide a translucent housing to the illuminable strand of light emitting diodes 11 which are coiled about an interior rod 22 located at the axis of the elongated body 24 and extending throughout the disc-shaped catch net assembly 14.

The plurality of light emitting diodes 11 are enclosed within a hermetically sealed flexible strand 26 with the strand length 28 defined by the length of the elongated body 13 and circumference of the disc-shaped body 30. The plurality of light emitting diodes 11 are further designed to include a plurality of colored diodes 32 electrically connected to a timer 34 within a microcontroller 36 which enable a variety of timed light schemes to be projected from each of the plurality of light emitting diodes 11 while conserving power and minimizing heat generation. Further, a multi-axis sensor 35 is electrically connected to the microcontroller 36 within the handle portion 18 which functions in synchrony with the plurality of light emitting diodes 11 and pre-programmed sounds. The apparatus 10 and multi-axis sensor 35 are designed to play a pre-programmed sound from the Bluetooth speaker 29 and/or initiate a colored light scheme from the plurality of colored diodes 32 when the multi-axis sensor 35 senses a movement. For example, if the child were to tilt the apparatus 10 from a vertical to horizontal position, the multi-axis sensor 35 would sense the movement and a pre-programmed sound such as "you can't catch me" would be heard from the speaker 29. In another example, if the apparatus were tipped "up-side down" the multi-axis sensor 35 would feel the change of position and light the plurality of colored diodes 32 for a period of time. In an alternative embodiment, a motor 37 may be further connected to a multi-axis sensor 35 to vibrate the apparatus 10 for a period of time.

The catch net assembly 14 has a disc-shaped configuration and is releasably attached to the first end of the elongated body 16 using a coupling 38 which connected the elongated body 12 to the catch net assembly 14 creating a hermetic seal. The hollow coupling 38 further allows the strand of illuminable light emitting diodes to be continuously coiled about the interior rod 22 which extends throughout the catch net assembly 14. Further attached about the perimeter of the catch net assembly 40 is the fabric mesh netting 42 which allows for both insects and fish to be captured therein. Further attached to both the catch net assembly and 14 and coupling is 38 is an elongated spring 43 and illuminable toy figurine 44.

The handle portion 18 located at the second end of the elongated body 20 and opposite the catch net assembly 15 further includes a power switch 45 and push-button actuator 46 which are both electrically connected to the at least one battery supply 48 and microcontroller 36.

Figure 2:
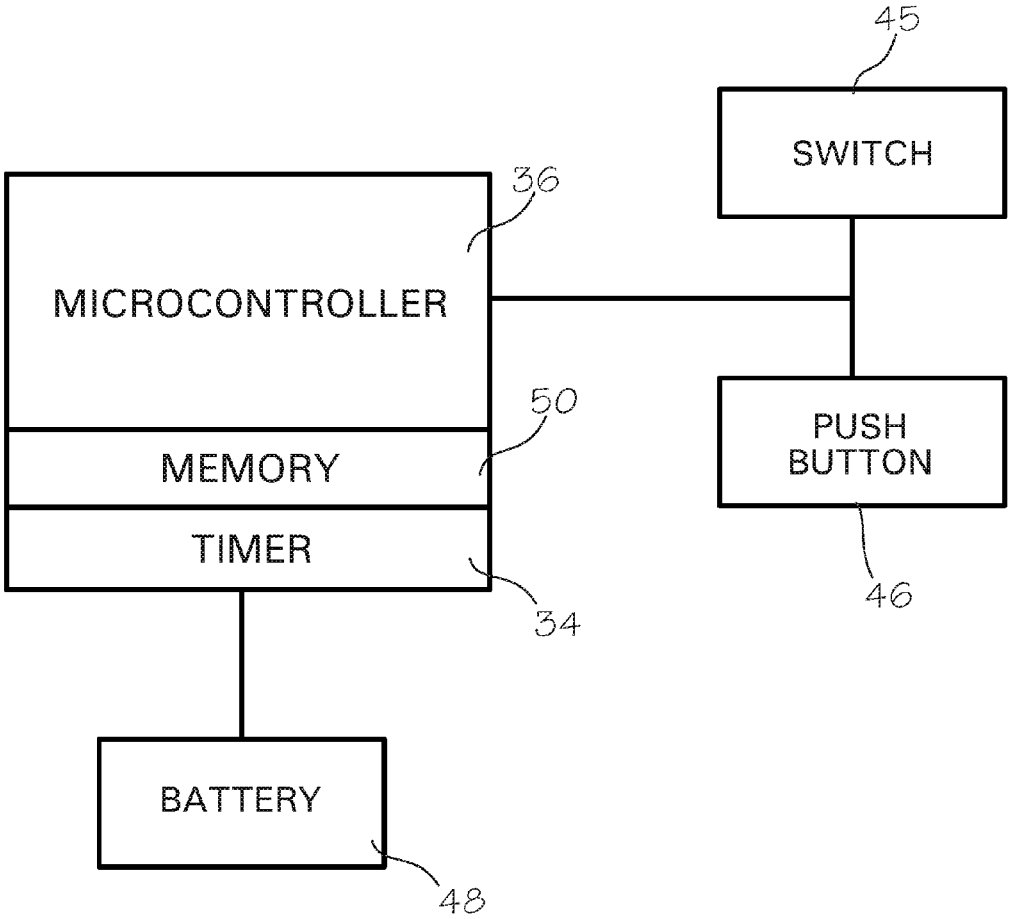
FIG. 2 is a is a block diagram of the microcontroller and integrated control architecture of the apparatus.

Shown in FIG. 2 is a block diagram of the microcontroller 36 and associated control architecture. The microcontroller 36 further includes a memory module 50 which enables a plurality of pre-programmed songs and sounds to be stored and selectively played by depressing the push-button actuator a pre-determined number of times. The microcontroller 36 is further connected to the timer 34 configured to at least control at least one light scheme of the illuminable light emitting diodes 11 and plurality of pre-programmed songs and sounds. Further, the apparatus 10 may include a Bluetooth speaker 52 within the handle portion 18 which is configured to play the plurality of pre-programmed sounds contained within the memory module 50.

Figure 3:
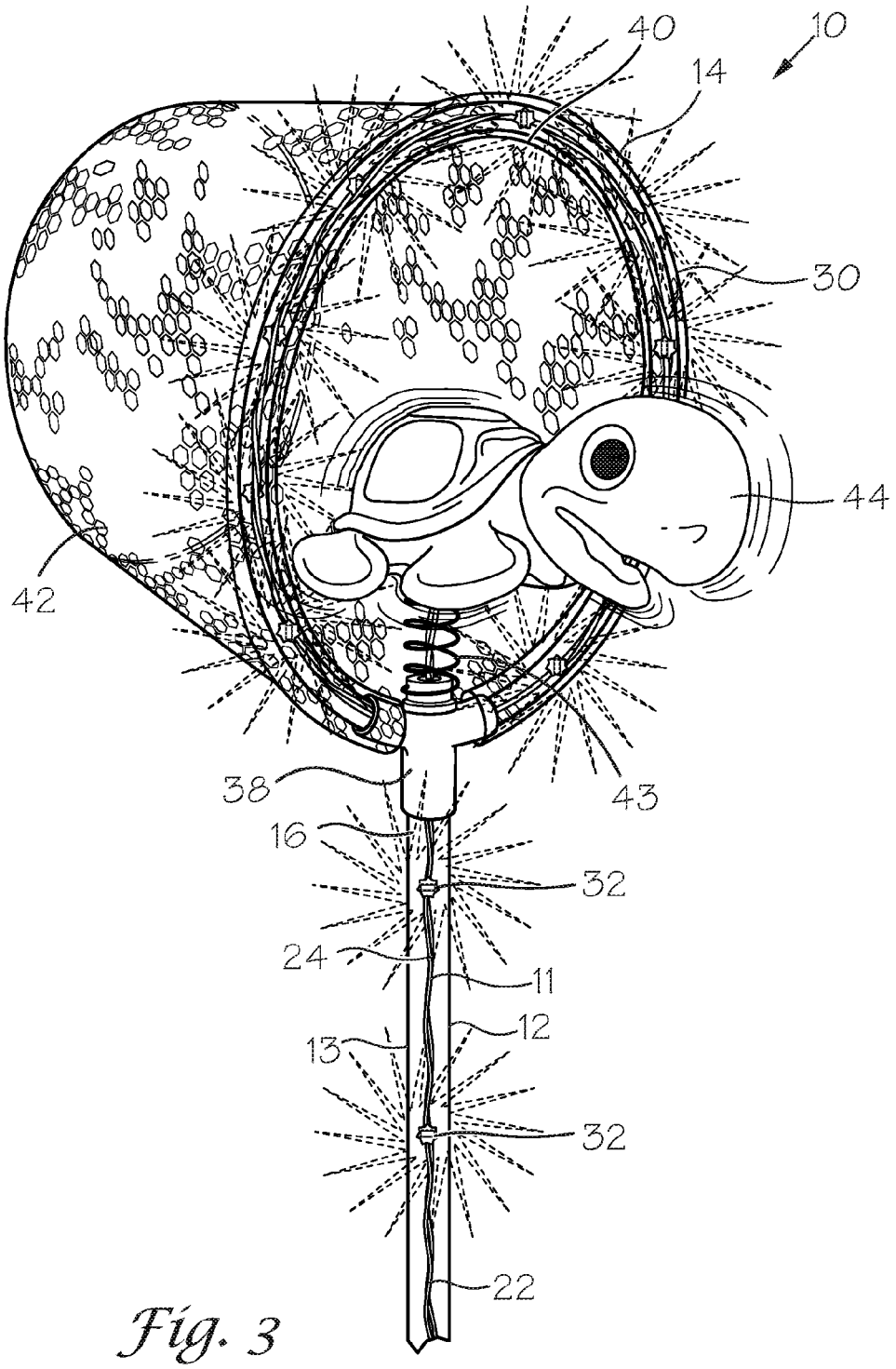
FIG. 3 is an alternative embodiment of the apparatus.

Shown in FIG. 3 is an alternative embodiment of the apparatus 10 with a variation to the toy figurine 44. Like the preferred embodiment of FIG. 1, the apparatus provides an interactive play experience where the user is able to wave the wand in the air and simulate capturing an insect within the fabric catch net assembly 42.

Figure 4:
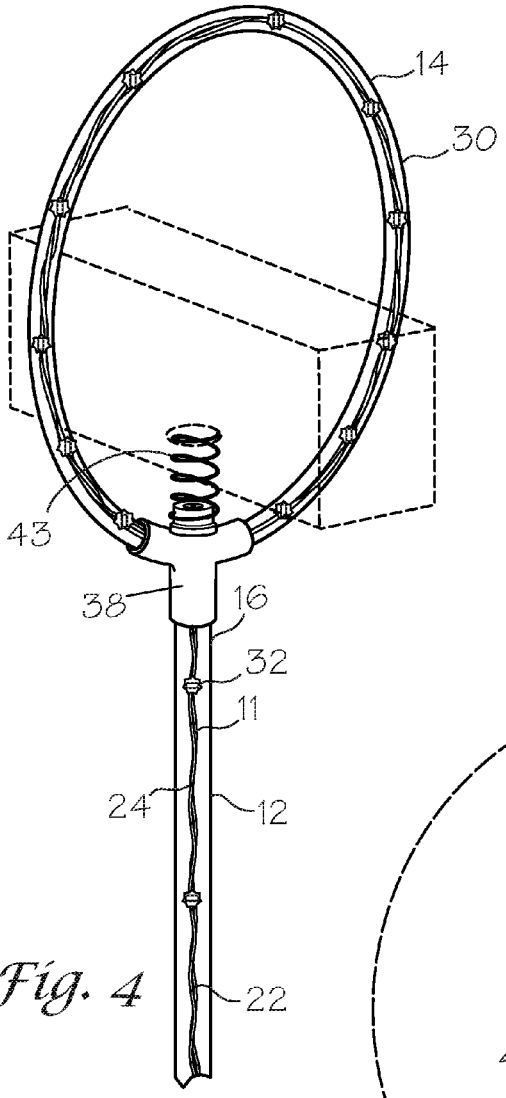
FIG. 4 is a view of the catch net assembly.

Shown in FIG. 4 is a view of the elongated body 12 releasably attached the catch net assembly 14 at the coupling 38. Further illustrated is the spring 43 which attaches to the catch net assembly 14 at a first end and to a toy figurine 44 at the second end. It is contemplated the apparatus 10 will enable a user to selectively exchange toy figurines 44 by removing from the first end of the spring 43.

Figure 5:
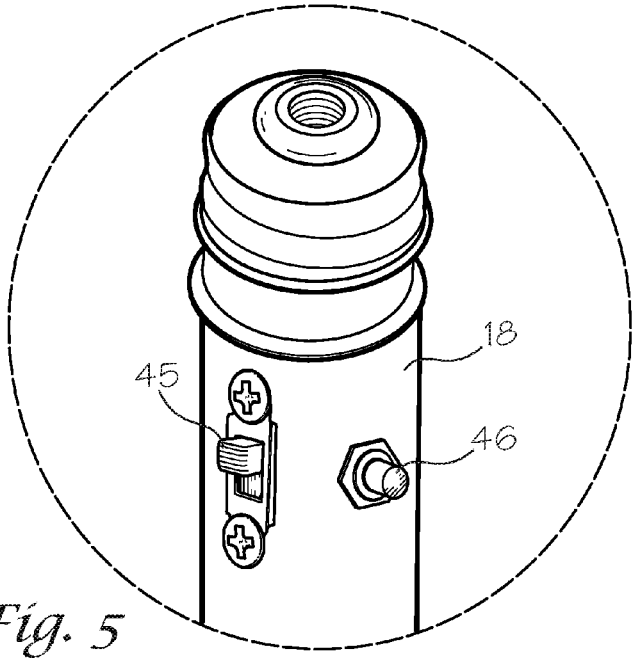
FIG. 5 is a detailed view of the handle portion of the apparatus.

Shown in FIG. 5 is a detailed view of the handle 18 including the power switch 45 which is electrically connected to the battery 48 to energize the apparatus by moving the selector between an upper "on" and lower "off" position. The push-button actuator 46 may be selectively depressed a pre-determined number of times to control the color scheme, light duration/flash, and control of the plurality of pre-programmed songs and sounds contained within the memory module 50.

It will be appreciated by persons skilled in the art that the present embodiment is not limited to what has been particularly shown and described hereinabove. In addition, unless mention was made above to the contrary, it should be noted that all of the accompanying drawings are not to scale. A variety of modifications and variations are possible in light of the above teachings without departing from the following claims.

What is claimed is:

1. An integrated hand-held catch net apparatus; the apparatus comprising:

an elongated and translucent body configured to releasably secure:

a speaker;

a flexible light strand having a plurality of light emitting diodes extending a length of the elongated and translucent body;

a handle portion including:

a microcontroller configured to control a colored light scheme and a preprogrammed sound when a push-button actuator is depressed;

a multi-axis sensor to sense a change of position of the apparatus;

a power source electrically connected to the at least a microcontroller and the multi-axis sensor;

a disc-shaped catch net releasably attached to a first end of the elongated and translucent body.

2. The apparatus of claim 1, wherein the speaker further includes a waterproof Bluetooth speaker and configured to connect to a smart device over a wireless network.

3. The apparatus of claim 2, wherein the microcontroller further includes a memory module containing a plurality of pre-programmed songs.

4. The apparatus of claim 1, wherein the disc-shaped catch net further includes a releasably attached toy figurine.

5. The apparatus of claim 4, wherein the releasably attached toy figurine is further configured to be selectively illuminated by depressing a push-button switch within a handle portion.

6. The apparatus of claim 1, wherein the disc-shaped catch net further includes a translucent and enclosed body about the circumference of the disc-shaped catch net.

7. A portable catch net apparatus, the apparatus comprising:

a catch net assembly connected to a first end of a translucent and elongated body and further including a releasably attached toy figurine;

a translucent and elongated body connecting the catch net assembly at a first end and a handle portion at a second end and configured to releasably house a flexible light strand including a plurality of light emitting diodes;

the handle portion configured to house:

a waterproof Bluetooth speaker in electrical communication with a microcontroller with integrated memory module;

a switch electrically connected to the flexible light strand and the microcontroller and configured to cause a light scheme or a preprogrammed sound by depressing a push-button actuator a pre-determined number of times; and a multi-axis sensor in electrical communication with a microcontroller and configured to transmit a signal when a change of position is sensed;

the microcontroller configured to:

store a plurality of pre-programmed songs within the integrated memory module;

light a plurality of colored light emitting diodes when a pushbutton actuator is depressed a pre-determined number of times; and receive a signal to cause at least one sound or a colored light scheme from the multi-axis sensor.

8. The apparatus of claim 7, wherein the handle portion further includes a push-button switch configured to selectively actuate:

the waterproof Bluetooth speaker; and the flexible light strand.

9. The apparatus of claim 8, wherein the catch net assembly further includes a translucent body about the circumference of the disc-shaped catch net to enable the flexible light strand to be visible.

10. The apparatus of claim 8, wherein the waterproof Bluetooth speaker is further configured to receive a signal over a wireless network from a smart device.

11. The apparatus of claim 8, wherein the light emitting diodes are further configured to selectively flash a plurality of color schemes.

12. The apparatus of claim 10, wherein the catch net assembly further includes an illuminable toy figurine attached to the inside surface of the translucent and elongated body using a spring.

13. The apparatus of claim 8, further including a hermetic seal to prevent moisture expose to the catch net assembly and the elongated and translucent body.

14. An interactive catch net assembly, the apparatus comprising:

a translucent and elongated body having a handle portion at a first end and a releasably attached translucent catch net assembly at the second end and releasably housing:

a waterproof Bluetooth speaker to enable a pre-programmed sound to be played;

a flexible strand of colored light emitting diodes coiled about an internal rod within the translucent and elongated body and configured to at least be illuminated when a change of position is sensed within a multi-axis sensor;

a microcontroller including a memory module in electrical communication with at least the Bluetooth speaker to enable a plurality of pre-programmed songs to be selectively played by depressing a push-button actuator of the handle portion;

the releasably attached translucent catch net assembly having an illuminable toy figurine and releasably attached to the first end of the translucent and elongated body using a coupling; and a motor electrically connected to the microcontroller and the multi-axis sensor to provide at least one oscillation frequency mode about an equilibrium point.

* * * * *